US006625089B2

(12) United States Patent
Stekelenburg

(10) Patent No.: US 6,625,089 B2
(45) Date of Patent: Sep. 23, 2003

(54) SETTING STRUCTURE OF ELECTRONIC TIMER

(75) Inventor: Albert Stekelenburg, Taipei (TW)

(73) Assignee: All-Time Inc., Taipei (TW)

( * ) Notice: Subject to any disclaimer, the term of this patent is extended or adjusted under 35 U.S.C. 154(b) by 0 days.

(21) Appl. No.: 09/767,877

(22) Filed: Jan. 24, 2001

(65) Prior Publication Data

US 2002/0097638 A1 Jul. 25, 2002

(51) Int. Cl.[7] ..... G04F 8/00; G04F 10/00; G04C 19/00

(52) U.S. Cl. ..... 368/107; 368/82; 368/239; 368/110; 368/112

(58) Field of Search ..... 368/30, 82–84, 368/107–113, 241–242; 362/362–375

(56) References Cited

U.S. PATENT DOCUMENTS 4,120,039 A * 10/1978 Fischer ..... 708/111
4,862,431 A * 8/1989 Drouin ..... 368/10
4,985,878 A * 1/1991 Yamada et al. ..... 368/88
5,138,590 A * 8/1992 Masuda et al. ..... 368/10
5,471,438 A * 11/1995 Kobayashi et al. ..... 368/281
6,069,848 A * 5/2000 McDonald et al. ..... 368/107
2001/0010662 A1 * 8/2001 Saitou ..... 368/281

* cited by examiner

*Primary Examiner*—David Martin
*Assistant Examiner*—Michael L. Lindinger
(74) *Attorney, Agent, or Firm*—Troxell Law Office PLLC

(57) ABSTRACT

A setting structure of electronic timer, its constitution includes a main body and a reveal able faceplate, a LED display is provided on the faceplate, a recess is provided on the main body there under, several keys are provided in the recess; setting position is via faceplate displayed by means of controlling and operating the keys; a projection is further provided under the faceplate, and a key is provided on main body of a relative position with the projection, the key can be indirectly depressed by depressing faceplate in order to achieve a function ON/OFF therein; a structure of timer with larger displaying faceplate and wider interval between keys is achieved by above-mentioned structure.

2 Claims, 3 Drawing Sheets

SETTING STRUCTURE OF ELECTRONIC TIMER

FIELD AND BACKGROUND OF THE INVENTION

The present application relates to a setting structure of time period setting device for timer, denotes especially a setting structure of electronic timer.

As shown in FIG. 1 is presently a conventional structure of electronic timer in market, its constitution includes further a time period setting part (including time display), the part includes at least a LED displaying faceplate C and several keys D, the displaying faceplate and keys are therefore very small, because the displaying faceplate and key must be harmonically provided on a limited and usable area, and erroneous setting is also easily formed for the man whose eyesight and controlling are not good, especially, the mistakes of setting are further easily produced when the light is bad.

SUMMARY OF THE INVENTION

The object of the present application is to provide a setting structure of electronic timer, which makes displaying faceplate and interval between keys larger, and is favorable for operation and setting.

Implementing above-mentioned object of present application adopts technical solution as below: its constitution includes a main body and a reveal able faceplate, the main body includes a power input plug and a power output, a reveal able faceplate is provided above main body, a recess is provided on main body under faceplate, several keys are provided in the recess; main body is a plat-like body structure, provided above main body and in the form of reveal able structure, a displaying faceplate is provided above faceplate, a LED display is provided in inner of faceplate, and is via bus connected to the inner of main body; a reveal able faceplate is provided on the main body, keys for setting are provided on the recess of main body under the reveal able faceplate, which forms a timer structure with larger faceplate and larger interval between keys; the structure provides further with a projection on the back of faceplate, the projection is respective to a key, a pre-set ON/OFF function of circuit is produced by means of depressing the faceplate downwards.

DETAILED DESCRIPTION OF A PREFERRED EMBODIMENT

Figure 1:
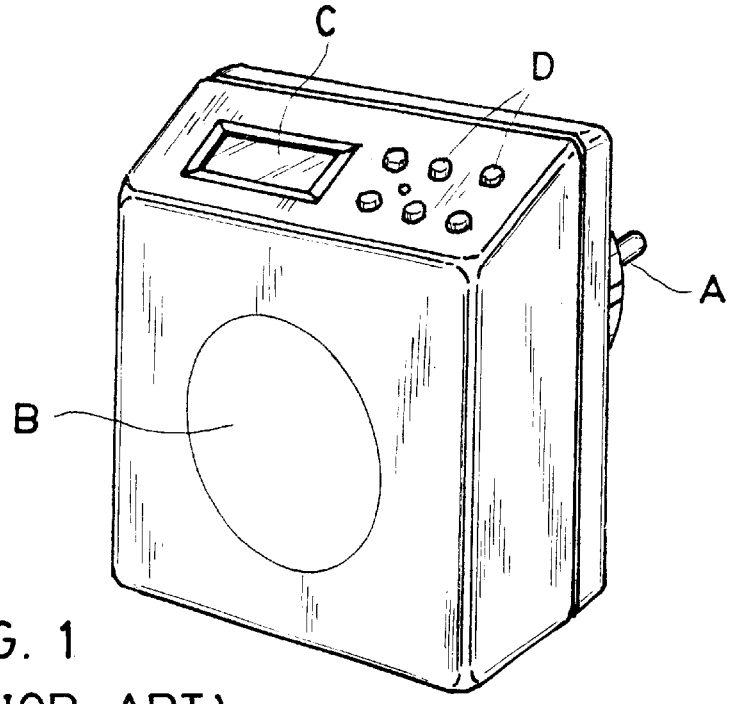
FIG. 1 (PRIOR ART)
FIG. 1 is a perspective view of conventional timer.
Figure 2:
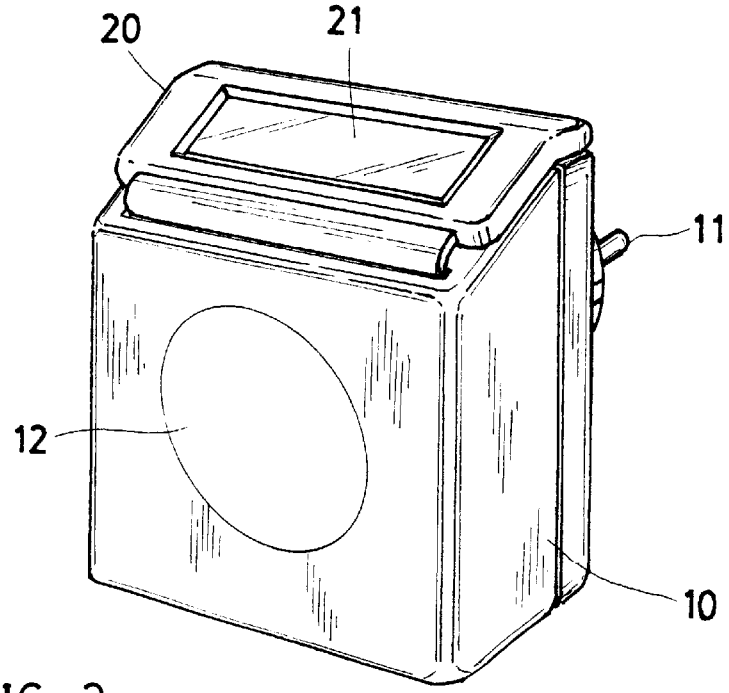
FIG. 2 is a perspective view (I) of timer of present application.

As shown in FIG. 2, the constitution of present application includes a main body 10, a faceplate 20. The constitution of main body 10 includes a power input plug 11, a power output 12, a reveal able faceplate 20 is provided above main body 10, displaying faceplate is provided on the faceplate 20.

Figure 3:
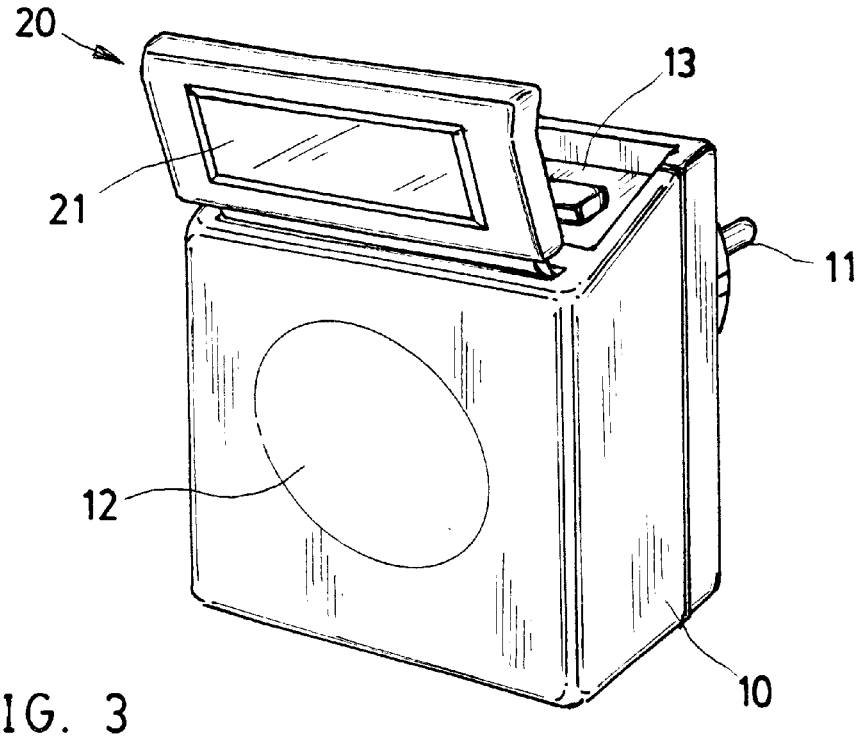
FIG. 3 is a perspective view (II) of timer of present application, (faceplate is in the position of revelation)

As show in FIG. 3, the faceplate 20 is in revealing position, the displaying function 21 is located in a position in which it's easily seen; a recess 13 is provided above main body 10 (i.e. under the facplate which is not revealed), several keys are provided in the recess 13 (please reference to FIG. 5), these keys 14, 15, 16 and reset key 17 etc are provided on a recess stand 18; the function and its related circuit of these keys 14, 15, 16 are same as or analogous to the setting structure of conventional timer, all of which are o longer described because which are not in the claimed scope.

Figure 4:
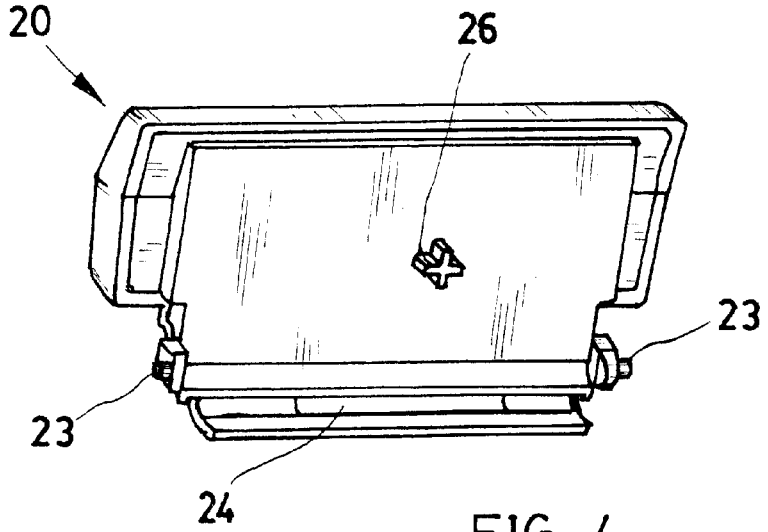
FIG. 4 is a perspective view of the back of faceplate.
Figure 5:
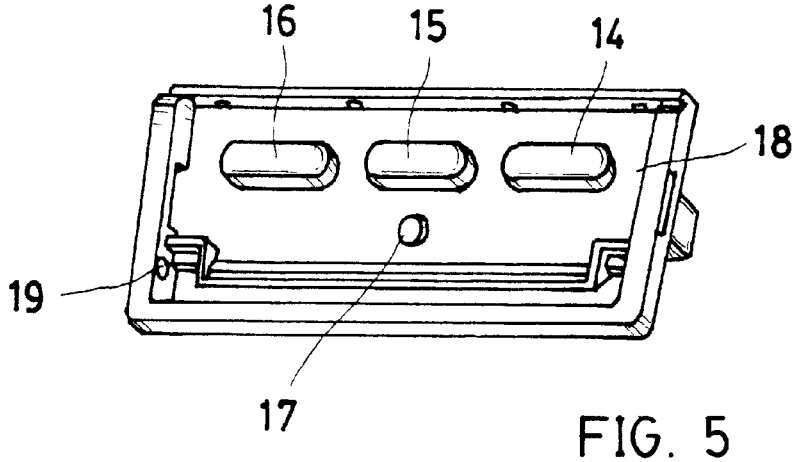
FIG. 5 is a perspective view of the recess stand.
Figure 6:
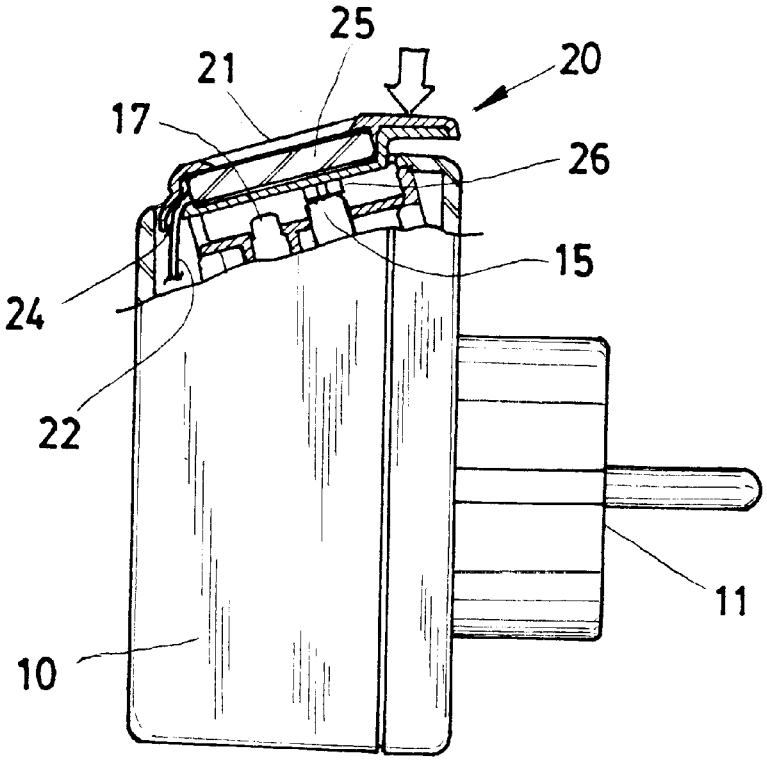
FIG. 6 is a partial sectional view of the present application.

Shown in FIGS. 4 and 5 are, respectively, perspective views of faceplate 20 and recess stand 18, FIG. 6 is an upper partial sectional view of an embodiment of present application; the faceplate 20 is via bus connected with circuit of main body 10, a pair of rotary axle 23 and a bus-hole 24 are provided on on side of afaceplate 20, the rotary axles 23 are mated with the axle-holes 19 at the side of recess stand 18 such that the faceplate 20 can be revealed or not revealed at the rotary axle 23; bus 22 introduced from the main body 10 is passed through bus-hole 24, the bus 22 is connected to LED display 25; a projection 26 is provided on the inner side of faceplate 20, the projection 26 is just against the tope of key 15 therein, when the faceplate 20 is put down (not in position of revelation), the key 15 is depressed and a pre-set function of circuit ON/OFF is produced when the faceplate 20 is depressed (reference to FIG. 6). The LED display is visible when the recess is covered and when the recess is revealed (see FIGS. 2 and 3).

In summary, the present application provides provides with a reveal able faceplate 20, a displaying faceplate 21 of LED display, which is larger than the conventional, is provided on the faceplate 20, the interval between key 14, 15, 16 and reset key 17 on the main body 10 is larger, as compared with conventional structure, a larger displaying faceplate 21 and larger interval between keys in achieved by present application, which is indeed a timer structure with improved effect.

In practice, due to that the specification of plug and socket in each country is various, the plug and socket as explaining in present application are expressed with block mode, which are not limited by the shown structure:

What is claimed is:

1. A settable electronic timer comprising:

a) a main body having a recess provided in at least one surface;

b) a plurality of keys provided in the recess;

c) a faceplate pivotally connected to the main body movable between a first position, wherein the face plate covers the recess, and a second position in which the recess is uncovered, the faceplate including an electrical visual display that is visible in both the first and second positions of the faceplate;

d) an electrical bus extending from the electrical visual display to a circuit in the main body; and, e) a projection projecting from the faceplate and aligned with one of the plurality of keys when the faceplate is in the first position, whereby, when the faceplate is moved toward the main body from the first position, the projection depresses the aligned key.

2. The settable electronic timer of claim 1 wherein the electrical visual display comprises an LED display.

* * * * *